US012410788B2

(12) United States Patent
Li et al.

(10) Patent No.: US 12,410,788 B2
(45) Date of Patent: Sep. 9, 2025

(54) PLUNGER PUMP AND PUMP STATION

(71) Applicants: CCTEG BEIJING TIANMA INTELLIGENT CONTROL TECHNOLOGY CO., LTD., Beijing (CN); BEIJING CCRI-TIANMA AUTOMATION TECHNOLOGY CO., LTD., Beijing (CN)

(72) Inventors: Ran Li, Beijing (CN); Wenshu Wei, Beijing (CN); Jian Ye, Beijing (CN); Hao Liu, Beijing (CN); Mengyu Wu, Beijing (CN); Rongming Chen, Beijing (CN); Dalong Wang, Beijing (CN); Jingbin Chen, Beijing (CN)

(73) Assignees: CCTEG BEIJING TIANMA INTELLIGENT CONTROL TECHNOLOGY CO., LTD., Beijing (CN); BEIJING CCRI-TIANMA AUTOMATION TECHNOLOGY CO., LTD., Beijing (CN)

( * ) Notice: Subject to any disclaimer, the term of this patent is extended or adjusted under 35 U.S.C. 154(b) by 169 days.

(21) Appl. No.: 18/006,332

(22) PCT Filed: Apr. 12, 2021

(86) PCT No.: PCT/CN2021/086360
§ 371 (c)(1),
(2) Date: Jan. 20, 2023

(87) PCT Pub. No.: WO2022/016911
PCT Pub. Date: Jan. 27, 2022

(65) Prior Publication Data

US 2023/0313792 A1 Oct. 5, 2023

(30) Foreign Application Priority Data

Jul. 23, 2020 (CN) ..... 202010718136.1

(51) Int. Cl.
*F04B 53/10* (2006.01)
*F04B 9/04* (2006.01)

(52) U.S. Cl.
CPC ..... *F04B 53/1022* (2013.01); *F04B 9/045* (2013.01); *F04B 53/1087* (2013.01); *F04B 53/109* (2013.01)

(58) Field of Classification Search
CPC . F04B 9/045; F04B 15/02; F04B 53/10–1097
See application file for complete search history.

(56) References Cited

U.S. PATENT DOCUMENTS 1,507,448 A * 9/1924 Aldrich ..... F16K 17/04 251/360
2,146,709 A * 2/1939 Bird ..... F04B 53/164 92/128

(Continued)

FOREIGN PATENT DOCUMENTS

CN 2771507 4/2006
CN 2898367 5/2007

(Continued)

OTHER PUBLICATIONS

WIPO, International Search Report for PCT/CN2021/086360, Jul. 16, 2021.

(Continued)

*Primary Examiner* — Alexander B Comley
(74) *Attorney, Agent, or Firm* — The Sun IP Law

(57) ABSTRACT

A plunger pump includes a pump head assembly, which includes: a pump head body, a chamber in the pump head body; a liquid suction valve assembly, a liquid discharge valve assembly, and a separation sleeve for separating the liquid suction valve assembly from the liquid discharge valve assembly that are located in the chamber. The chamber includes: a liquid suction valve base mounting portion for mounting the liquid suction valve assembly, a separation (Continued)

sleeve mounting portion for mounting the separation sleeve, a liquid discharge valve base mounting portion for mounting the liquid discharge valve assembly, and a liquid suction chamber on a lower side of the liquid suction valve base mounting portion and in communication with an emulsion supply device by a pipeline.

15 Claims, 6 Drawing Sheets

(56) References Cited

U.S. PATENT DOCUMENTS

| | | | | |
|---|---|---|---|---|
| 2,559,659 | A * | 7/1951 | Redman | F04B 53/1025 417/568 |
| 2,766,701 | A * | 10/1956 | Giraudeau | F04B 53/14 277/525 |
| 3,053,500 | A * | 9/1962 | Atkinson | F16K 1/38 251/332 |
| 4,188,174 | A * | 2/1980 | Perkins | F04B 53/1087 137/246.22 |
| 4,520,837 | A * | 6/1985 | Cole | E21B 33/13 417/568 |
| 6,910,871 | B1 * | 6/2005 | Blume | F04B 53/007 417/454 |
| 7,364,412 | B2 * | 4/2008 | Kugelev | F04B 53/1032 417/454 |
| 8,147,227 | B1 * | 4/2012 | Blume | F04B 53/164 137/512 |
| 10,094,376 | B1 * | 10/2018 | Vicars | F04B 39/122 |
| 2017/0051732 | A1 * | 2/2017 | Hemandez | F04B 17/06 |
| 2017/0159655 | A1 * | 6/2017 | Morreale | F16K 15/026 |
| 2018/0355449 | A1 * | 12/2018 | Underys | C21D 9/00 |
| 2019/0055937 | A1 * | 2/2019 | Parmeshwar | F04B 9/045 |
| 2020/0362678 | A1 * | 11/2020 | Lesko | F04B 9/045 |
| 2021/0239229 | A1 * | 8/2021 | Kelton | F04B 1/0461 |

FOREIGN PATENT DOCUMENTS

| | | |
|---|---|---|
| CN | 205605419 | 9/2016 |
| CN | 205605419 U * | 9/2016 |
| CN | 206439170 | 8/2017 |
| CN | 206439170 U * | 8/2017 |
| CN | 109538460 | 3/2019 |
| CN | 209278105 | 8/2019 |
| CN | 111255678 | 6/2020 |
| CN | 111255678 A * | 6/2020 |
| CN | 211009053 | 7/2020 |
| EP | 2484949 | 8/2012 |
| EP | 3146210 | 4/2020 |
| WO | WO-2014186512 A1 * | 11/2014 |

OTHER PUBLICATIONS

CNIPA, First Office Action for CN Application No. 202010718136.1, Dec. 10, 2024.

* cited by examiner

PLUNGER PUMP AND PUMP STATION

CROSS-REFERENCE TO RELATED APPLICATIONS

This application is a U.S. national stage entry of International Application No. PCT/CN2021/086360, filed Apr. 12, 2021, which claims priority to Chinese Patent Application No. 202010718136.1, filed Jul. 23, 2020, the entire disclosures of which are incorporated herein by reference.

FIELD

The present disclosure relates to an emulsion pump station, and more particularly to a five-plunger emulsion pump and a pump station.

BACKGROUND

Emulsion pump stations are essential and important equipment for fully mechanized coal mining faces, which provide hydraulic power for hydraulic supports of the faces and are the core of the hydraulic system for the whole faces. In recent years, with the increasing number of working faces with large mining height in China, higher requirements have been put forward for the reliability of emulsion pump stations, in order to meet the requirements of high support resistance and high working resistance of hydraulic supports with large mining height, as well as the requirements of fast moving and safe support.

At present, the emulsion pump generally adopts large-flow emulsion pumps with a five-plunger structure or a seven-plunger structure, which have the advantages of high transmission efficiency, stable support, small axial force component of gear pair, and compact structure, and are widely used.

In the related art, a liquid suction valve core assembly and a liquid discharge valve assembly in a pump head body of a plunger pump are assembled from both sides of the pump head body, so during replacement of a liquid suction valve base, a liquid suction valve core, a liquid discharge valve base, and a liquid discharge valve core, parts such as a suction pipe, a suction box and the like need to be removed, which leads to poor operability, long maintenance time and high maintenance cost. Additionally, in the plunger pump of the related art, a reset spring mounting seat for the liquid suction valve core is generally designed at a lower part of the liquid discharge valve core. On one hand, the mass of the liquid discharge valve core is increased, and the inertia force becomes large; on the other hand, high-pressure liquid flow generates impact on the liquid suction valve core and the liquid discharge valve core, which are subjected to large force on one side, and when the valve core rises up or down, guide parts are subjected to eccentric wear, and in turn sealing annular surfaces undergo eccentric wear, which affects the service life. The pump head body and the suction box of the existing plunger pump are two independent parts, and during their installation, it is necessary to provide a long installation hole in the suction box, and the two parts are assembled or disassembled by a long screw, which leads to higher manufacturing and assembly costs.

Moreover, current monitoring techniques for pump stations mainly include monitoring of gear oil in a crankcase (oil temperature monitoring, oil pressure monitoring, oil level monitoring), monitoring of water pressure at a hydraulic end, and motor temperature monitoring. Some patents also involve monitoring of vibration and oil quantity of mechanical equipment. However, due to the limitation of installation space and the influence of transmission signals, sensors are generally mounted outside the pump stations. At present, there is no monitoring of built-in precision core components such as suction and liquid discharge valve cores at the hydraulic end of the pump station.

SUMMARY

A plunger pump includes: a crankcase assembly configured to be coupled to a main drive motor to transmit power; a pump head assembly configured to pump emulsion; and a hydraulic conversion assembly coupled between the crankcase assembly and the pump head assembly and configured to convert mechanical power of the crankcase assembly into a hydraulic change of the pump head assembly. The pump head assembly includes: a pump head having a chamber; a liquid suction valve assembly, a liquid discharge valve assembly and a separation sleeve separating the liquid suction valve assembly from the liquid discharge valve assembly, all of which are in the chamber. The chamber includes a liquid suction valve base mounting portion for mounting the liquid suction valve assembly, a separation sleeve mounting portion for mounting the separation sleeve, a liquid discharge valve base mounting portion for mounting the liquid discharge valve assembly, and a liquid suction chamber at a lower side of the liquid suction valve base mounting portion. The liquid suction chamber is in connection with an emulsion supply device through a pipeline. The liquid discharge valve base mounting portion is transitioned to the separation sleeve mounting portion through a stepped surface; a bore diameter of the liquid discharge valve base mounting portion is larger than a bore diameter of the separation sleeve mounting portion; and the bore diameter of the separation sleeve mounting portion is larger than or equal to a bore diameter of the liquid suction valve base mounting portion.

The present disclosure also provides a pump station that includes a base; and a plunger pump and a main drive motor being both on the base, in which the main drive motor is configured to drive the plunger pump. The plunger pump includes: a crankcase assembly configured to be coupled to a main drive motor to transmit power; a pump head assembly configured to pump emulsion; and a hydraulic conversion assembly coupled between the crankcase assembly and the pump head assembly and configured to convert mechanical power of the crankcase assembly into a hydraulic change of the pump head assembly. The pump head assembly includes: a pump head having a chamber; a liquid suction valve assembly, a liquid discharge valve assembly and a separation sleeve separating the liquid suction valve assembly from the liquid discharge valve assembly, all of which are in the chamber. The chamber includes a liquid suction valve base mounting portion for mounting the liquid suction valve assembly, a separation sleeve mounting portion for mounting the separation sleeve, a liquid discharge valve base mounting portion for mounting the liquid discharge valve assembly, and a liquid suction chamber at a lower side of the liquid suction valve base mounting portion. The liquid suction chamber is in connection with an emulsion supply device through a pipeline. The liquid discharge valve base mounting portion is transitioned to the separation sleeve mounting portion through a stepped surface; a bore diameter of the liquid discharge valve base mounting portion is larger than a bore diameter of the separation sleeve mounting portion; and the bore diameter of the separation sleeve mounting portion is larger than or equal to a bore diameter of the liquid suction valve base mounting portion.

BRIEF DESCRIPTION OF DRAWINGS

Embodiments of the present disclosure will be described in detail below with reference to the accompanying drawings, which will help to understand the objectives and advantages of the present disclosure, in which.

DETAILED DESCRIPTION

Technical solutions of the present disclosure will be clearly and completely described below with reference to the drawings. Obviously, the described embodiments are merely some rather than all of the embodiments of the present disclosure. Based on the embodiments of the present disclosure, all other embodiments obtained by those skilled in the art without creative effort fall into the scope of the present disclosure. In addition, technical features involved in different embodiments of the present disclosure described below can be combined with each other as long as they do not contradict with each other.

The first technical problem to be solved by the present disclosure is that an unreasonable structure of the existing plunger pump leads to time-consuming and laborious disassembly and assembly of the pump head.

The present disclosure provides the following technical solutions aiming at the above technical problem.

Figure 1:
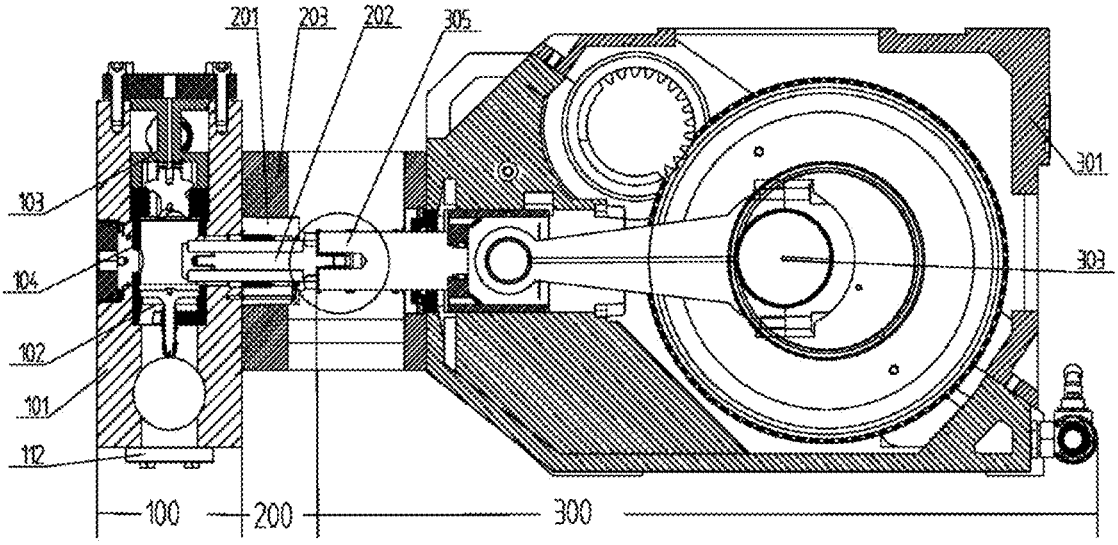
FIG. 1 is a sectional view of a specific embodiment of a plunger pump according to the present disclosure.
Figure 2:
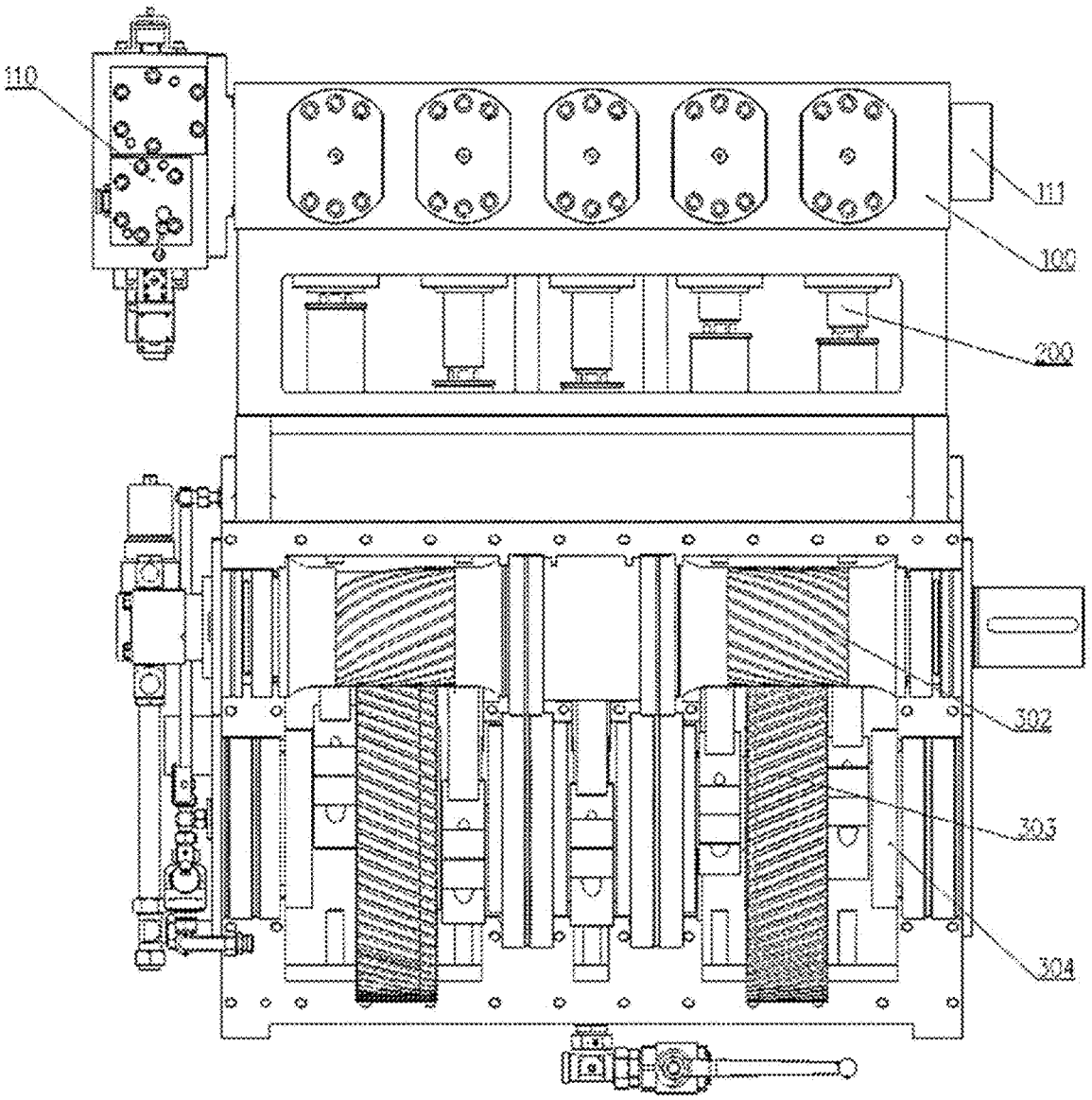
FIG. 2 is a structural diagram of a specific embodiment of a plunger pump according to the present disclosure.

FIG. 1 and FIG. 2 show a specific embodiment of a plunger pump according to the present disclosure, and the plunger pump in this embodiment is a five-plunger emulsion pump. The plunger pump A includes three parts. A first part is a crankcase assembly 300 configured to be coupled to a main drive motor to transmit power; a second part is a pump head assembly 100 configured to pump emulsion; a third part is a hydraulic conversion assembly 200 configured to convert mechanical power of the crankcase assembly 300 into a hydraulic change of the pump head assembly 100. One end of the hydraulic conversion assembly 200 is coupled to the crankcase assembly 300, and the other end of the hydraulic conversion assembly 200 is coupled to the pump head assembly 100.

The structures of the above three parts and their connection will be described below.

<Pump Head Assembly 100>

Figure 3:
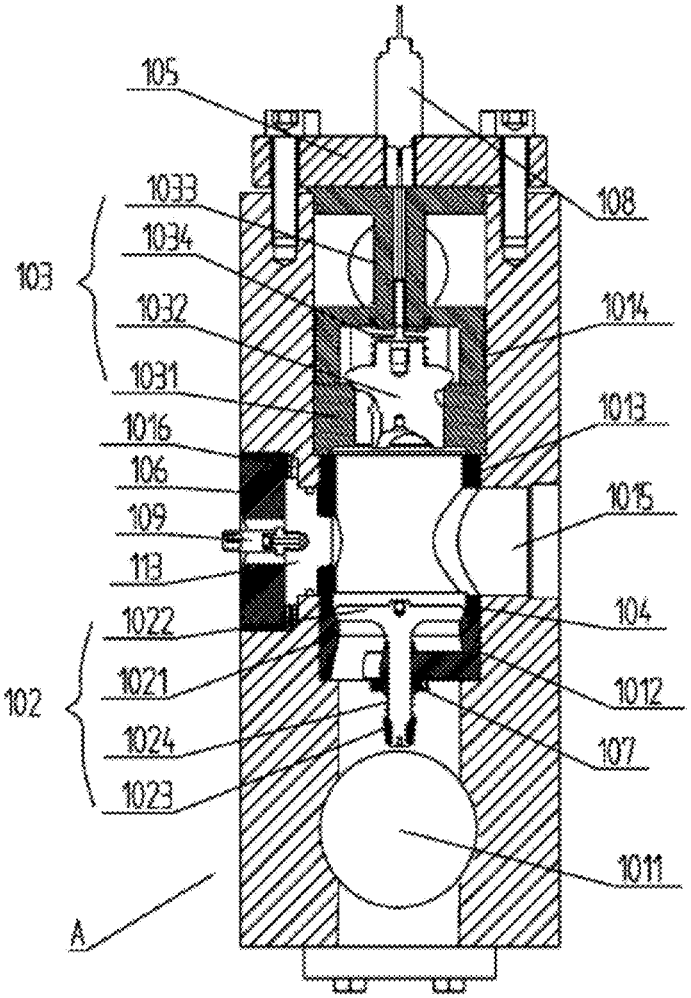
FIG. 3 is a sectional view of a plunger head assembly of a plunger pump according to the present disclosure.

As shown in FIG. 3, the pump head assembly 100 includes: a pump head body 101; a liquid suction valve assembly 102, a liquid discharge valve assembly 103, a separation sleeve 104 configured to separate the liquid suction valve assembly 102 from the liquid discharge valve assembly 103, the liquid suction valve assembly 102, the liquid discharge valve assembly 103 and the separation sleeve 104 being all on an inner side of the pump head body 101; a liquid suction chamber blocking plate 112 configured to block a lower opening of the pump head body 101; and a liquid discharge chamber blocking cover 105 configured to block an upper opening of the pump head body 101.

The pump head body 101 is a chamber structure with upper and lower openings. The chamber includes: a liquid suction valve base mounting portion 1012 for mounting the liquid suction valve assembly 102; a separation sleeve mounting portion 1013 for mounting the separation sleeve 104; a liquid discharge valve base mounting portion 1014 for mounting the liquid discharge valve assembly 103; and a liquid suction chamber 1011 at a lower side of the liquid suction valve assembly 102, in which the liquid suction chamber 1011 is in connection with an emulsion supply device (not shown) through a pipeline.

In order to facilitate the installation of various components, the transition between the liquid discharge valve base mounting portion 1014 and the separation sleeve mounting portion 1013 is achieved by a stepped surface; a bore diameter of the liquid discharge valve base mounting portion 1014 is larger than a bore diameter of the separation sleeve mounting portion 1013; and the bore diameter of the separation sleeve mounting portion 1013 is larger than or equal to a bore diameter of the liquid suction valve base mounting portion 1012. In this way, when the liquid suction valve assembly 102, the liquid discharge valve assembly 103 and the separation sleeve 104 are mounted, the liquid suction valve assembly 102 can easily enter the liquid suction valve base mounting portion 1012 through the liquid discharge valve base mounting portion 1014 and the separation sleeve mounting portion 1013; the separation sleeve 104 enters the separation sleeve mounting portion 1013 after passing through liquid suction valve base mounting portion 1012; and then the liquid discharge valve assembly 103 is mounted. As a result, the liquid suction valve assembly 102, the liquid discharge valve assembly 103, and the separation sleeve 104 can be assembled and disassembled through the upper opening of the chamber.

Since the liquid suction valve assembly 102, the liquid discharge valve assembly 103 and the separation sleeve 104 are all mounted from one side, components can be removed simply by opening an upper end of the pump head body 101 when the components in the pump head need to be repaired. Meanwhile, since the liquid suction valve assembly 102, the liquid discharge valve assembly 103 and the separation sleeve 104 are all mounted from one side, axial fit relationship of various components can be easily guaranteed, and mutual interference caused by poor position matching in case of installation from both sides can be avoided.

Meanwhile, the liquid suction chamber is formed directly inside the pump head body 101, which can avoid problems of high manufacturing cost and time-consuming and laborious assembly due to detachable connection between a liquid suction part and the pump head body 101.

In addition, in the present disclosure, the liquid suction valve assembly 102 and the liquid discharge valve assembly 103 are separated by the separation sleeve 104 and are structurally independent, which can prevent liquid flow from impacting the liquid suction valve core and the liquid discharge valve core in the process of liquid suction and liquid discharge, especially in the process of high-pressure liquid discharge. Moreover, there is no unilateral stress problem, so that no eccentric wear occurs to guide parts during opening or closing of the valve core, and in turn sealing annular surfaces is not subjected to eccentric wear and have a longer service life.

Specifically, the liquid suction chamber 1011 is formed as a spherical chamber structure, and a diameter of the spherical chamber larger than diameters of other parts of the chamber, to ensure that sufficient emulsion enters the chamber on an upper side of the liquid suction valve core during suction.

The compositions and structures of the liquid suction valve assembly 102, the liquid discharge valve assembly 103, and the separation sleeve 104 will be described below.

<Liquid Suction Valve Assembly 102>

As shown in FIG. 3, the liquid suction valve assembly 102 includes a liquid suction valve base 1021, a liquid suction valve core 1022, a reset spring mounting seat 1023 at the lower side of the liquid suction valve base 1021 and a first reset spring 1024.

The liquid suction valve core 1022 slides up and down along the liquid suction valve base 1021 by the action of hydraulic force, the first reset spring 1024 is used to provide downward elastic force to the liquid suction valve core 1022 and block the opening of the liquid suction valve base 1021. The reset spring mounting seat 1023 is installed at the lower side of the liquid suction valve base 1021. Compared with the related art, the lower end of liquid discharge valve core is designed with a spring mounting seat for resetting the liquid suction valve core 1022. When the liquid suction valve core 1022 is reset, it is not affected by the action of the liquid discharge valve core, the liquid suction valve core has reliable valve closing, less impact and longer service life.

Specifically, the reset spring mounting seat 1023 is fitted over the liquid suction valve core 1022, both of the reset spring mounting seat 1023 and the liquid suction valve core 1022 can fitted by screw or interference fit. The reset spring mounting seat 1023 is installed on the liquid suction valve core 1022 to make the liquid suction valve assembly 102 completely independent of the liquid discharge valve assembly 103, which is convenient for assembly and disassembly.

Specifically, the liquid suction valve base 1021 is in clearance fit with the pump head body 101, and the sealing connection is realized by a sealing ring to facilitate the liquid suction valve base 1021. Specifically, the sealing connection style between the liquid suction valve base 1021 and the mounting portion 1012 of the liquid suction valve base, as a preference, there is a sealing groove on the outer side of the liquid suction valve base 1021, and an O-shaped sealing ring and two sealing retaining rings are arranged in the sealing groove, and the two of the sealing retaining rings are arranged at the upper and lower sides of the O-shaped sealing ring respectively. Due to the high liquid pressure of emulsion pump, sealing rings made of polyoxymethylene are designed on both sides of the O-shaped sealing retaining ring to prevent from being damaged by the high-pressure emulsion.

Figure 5:
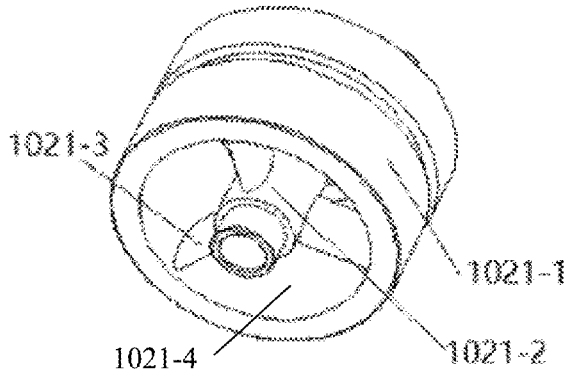
FIG. 5 is a structural diagram of a liquid suction valve base in a plunger pump according to the present disclosure.

Specifically, as shown in FIG. 5, the liquid suction valve base 1021 includes: an outer sleeve 1021-1, an inner sleeve 1021-2 and a transition arm 1021-3 connecting the inner sleeve 1021-2 and the outer sleeve 1021-1.

The outer wall of the outer sleeve 1021-1 is hermetically coupled to the mounting portion 1012 of the liquid suction valve base 1021, the terminal of the inner wall of the outer sleeve 1021-1 is provided with a first matching surface 1021-4 for matching with the liquid suction valve core 1022; the inner wall of the inner sleeve 1021-2 is slidably coupled to the liquid suction valve core 1022.

Figure 6:
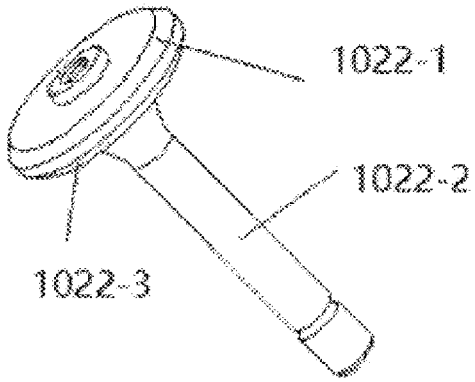
FIG. 6 is a structural diagram of a liquid suction valve core in a plunger pump according to the present disclosure.

As shown in FIG. 6, the liquid suction valve core includes: a valve core head 1022-1 and a valve core rod 1022-2, the valve core head 1022-1 is configured for matching with outer sleeve 1021-1, the valve core rod 1022-2 is slidably coupled to the inner sleeve 1021-2 of the liquid suction valve base 1021.

The liquid suction valve base 1021 mentioned above adopts the structure of inner side sleeved the outer side, and the liquid suction valve core 1022 adopts the structure of valve core head 1022-1 and valve core rod 1022-2, so that the liquid suction valve core 1022 can reliably slide along the inner sleeve of the liquid suction valve base 1021, thus preventing the liquid suction valve core form shaking radially relative to the liquid suction valve base in the related art.

The valve core head 1022-1 is provided with a second matching surface 1022-3, which matches with the first matching surface 1021-4. The first matching surface 1021-4 and the second matching surface 1022-3 are formed as conical surfaces; the liquid suction valve core 1022 and the liquid suction valve base 1021 are matched by the conical surfaces, so that the sealing performance between them is better; meanwhile, the liquid suction valve core 1022 can be compensated automatically after being worn, and the service life is prolonged.

In order to detect the impact force of the liquid suction valve core 1022, as shown in FIG. 3, the bottom of the liquid suction valve base 1021 is provided with a pressure sensor 107, the pressure sensor 107 is configured for detecting the impact force acting on the liquid suction valve base 1021. The pressure sensor 107 is monitors the impact force of each liquid suction and discharge valve core action in real time, and can also calculate the impact frequency according to the impact force variation curve. When the impact force and the frequency are greatly deviated from the normal state, it can be determined that the group of liquid suction and discharge valve cores have failed, and alarm is given to the operator to disassemble and check. The signal line of pressure sensor 107 is coupled to the wireless transmitter by wire, which is embedded in the outer surface of the pump body, the wireless transmitter transmits the pressure value to the controller by wireless signal.

<Liquid Discharge Valve Assembly 103>

As shown in FIG. 3, the liquid discharge valve assembly 103 includes a liquid discharge valve base 1031, a liquid discharge valve core 1032 slidably coupled to the liquid discharge valve base 1031, a liquid discharge valve core stop member 1033 at the upper side of the liquid discharge valve base 1031 and a second reset spring 1034. The liquid discharge valve core 1032 slides up and down along the liquid discharge seat under the hydraulic force, the second reset spring 1034 is used to provide elastic force downward to the liquid discharge valve core 1032, and to block the opening of the liquid suction valve base 1021. The liquid discharge valve core stop member 1033 plays a role of installing the second reset spring 1034 and also plays a role of blocking the liquid discharge chamber, the liquid discharge valve core stop member 1033 is axially sealed, and the axial limit is performed at the same time.

In order to ensure the reliable connection between the liquid discharge valve core stop member 1033, the upper side of the pump head body 101 is provided with a liquid discharge chamber blocking cover 105 for blocking the upper opening of the chamber, and the liquid discharge chamber blocking cover 105 presses against the liquid discharge valve core stop member 1033 and is coupled to the pump head body 101 by screws.

Figure 7:
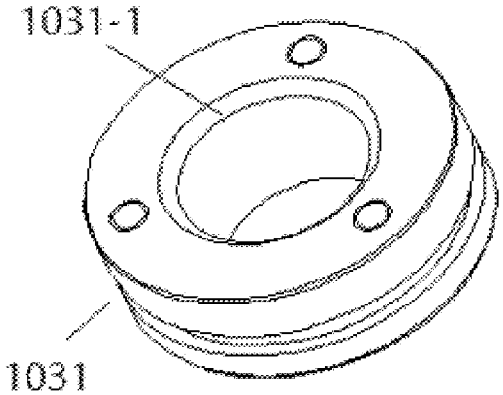
FIG. 7 is a structural diagram of a liquid discharge valve base in a plunger pump according to the present disclosure.
Figure 8:
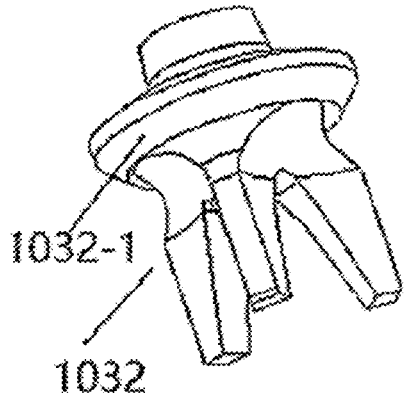
FIG. 8 is a structural diagram of a liquid discharge valve core in a plunger pump according to the present disclosure.

Specifically, as shown in FIG. 7, the liquid discharge valve base 1031 is provided with a third matching surface 1031-1. As shown in FIG. 8, the liquid discharge valve core 1032 is provided with a fourth matching surface 1032-1 that mates with the third matching surface 1031-1. The third matching surface 1031-1 and the fourth matching surface 1032-1 are formed as conical surface; the liquid discharge valve core 1032 and the liquid discharge valve base 1031 are matched by conical surfaces, so that the sealing performance between them is better; meanwhile, the compensation can be realized automatically after being worn, and the service life is prolonged.

Figure 9:
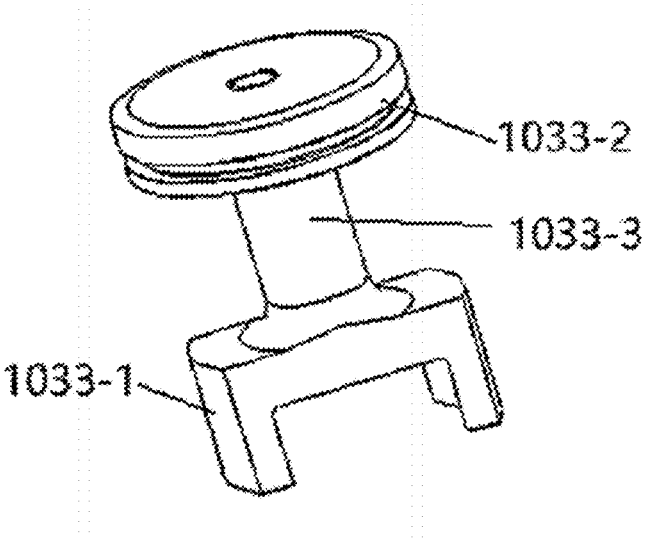
FIG. 9 is a structural diagram of a liquid discharge valve core stop member in a plunger pump according to the present disclosure.

Specifically, as shown in FIG. 3, the liquid discharge valve core stop member 1-33 is arranged between the liquid discharge valve base 1031 and the upper end of the pump head body 101. As shown in FIG. 9, the liquid discharge valve core stop member 1033 includes a spring holder part 1033-1 at the lower side, a blocking part 1033-2 at the upper side and a connecting part 1033-3 between them.

The spring holder part 1033-1 includes a supporting plate extending horizontally and a supporting arm extending downward along the supporting plate, the supporting arm abuts against the upper end of the liquid discharge valve base 1031, and a convex or circular snap ring for positioning the second reset spring 1034 is formed on the supporting plate.

The outer wall surface of the blocking part 1033-2 has a stepped surface, the cylindrical surface of the blocking part 1033-2 at the lower side of the stepped surface is hermetically coupled to the inner wall of the pump head body 101, the cylindrical surface of the blocking part 1033-2 located on the upper side of the stepped surface is pressed against the upper end of the pump head body 101. The structure of stepped surface of the blocking part 1033-2 can avoid the problem that the sealing performance of the pump head body 101 is not easy to be ensured since there is a gap between the liquid discharge valve core stop member 1033 and the liquid discharge chamber blocking cover 105 in the structure without stepped surface. On the other hand, the blocking part 1033-2 without a stepped surface cannot realize axial positioning, when the axial dimension of the liquid discharge valve core stop member 1033 is lower than the distance between the end of the pump head body 1-1 and the upper surface of the liquid discharge valve base 1031, it will cause the liquid discharge valve core stop member 1033 to shift up and down; axial positioning is carried out by the stepped surface of the blocking part 1033-2, which fixes the position of the liquid discharge valve core stop member 1033 relative to the pump head body 101 and reduces the machining accuracy of the liquid discharge valve core stop member 1033.

Specifically, the upper end of the liquid discharge valve core 1032 is formed with a cylindrical protrusion, and one end of the reset spring is fitted over the cylindrical protrusion.

In order to detect the linear displacement of the liquid discharge valve core 1032, as shown in FIG. 3, the liquid discharge chamber blocking cover 105 and the liquid discharge valve core stop member 1033 are provided with through holes communicating with each other from top to bottom, and the liquid discharge valve core 1032 is provided with threaded holes; a magnetostrictive sensor 108 is installed on the liquid discharge chamber blocking cover 105, and the telescopic rod of the magnetostrictive sensor 108 is coupled to a transition connecting rod, and the lower end of the transition connecting rod is coupled to the threaded hole of the liquid discharge valve core 1032 in a threaded manner. In this way, the fixed connection between the telescopic rod of the magnetostrictive sensor 108 and the liquid discharge valve core 1032 is realized, and the magnetostrictive sensor can calculate the operating frequency according to the displacement stroke variation curve of the liquid discharge valve core 1032, when the displacement stroke and the frequency are greatly deviated from the normal state, it can be determined that the group of the liquid suction and discharge valve core have failed, and an alarm will remind the operator to disassemble and check.

<Separation Sleeve 104>

As shown in FIG. 3, the separation sleeve 104 is formed as a cylinder sleeve, the cylinder sleeve has two coaxially through holes in the radial direction As shown in FIG. 3, the pump head body 101 is formed with a first through hole 1015 and a second through hole 1016 which are coaxial in the radial direction in the region of the separation sleeve mounting portion 1013, the first through hole 1015 is used to communicate with the hydraulic conversion assembly; the second through hole 1016 is provided with an anti-rotation memberanti-rotation member 113 for preventing the separation sleeve 104 from rotating and a blocking memberblocking member 106 for fixing the anti-rotation memberanti-rotation member 113.

In order to detect a vibration signal of the pump head body 101, the pump head body 101 further provided with a vibration sensor 109. Specifically, as shown in FIG. 3, in the middle of the blocking memberblocking member 106, there is a through hole, the anti-rotation memberanti-rotation member 113 is provided with a threaded mounting hole, the vibration sensor 109 is screwed to the threaded mounting hole of the anti-rotation memberanti-rotation member 113. The vibration sensor 109 detect the vibration signal of the pump head body 101 in real time every time the liquid discharge valve core 1032 moves, according to the vibration signal, the acceleration spectrum curve is calculated. When the vibration spectrum is greatly deviated from the normal state, it can be determined that the group of the liquid discharge valve core 1032 have failed, and an alarm is given to remind the operator to disassemble and check.

In the embodiments of the present disclosure, the pressure sensor 107, the magnetostrictive sensor 108 and the vibration sensor 109 are integrated in the pump head assembly, so that the impact force, displacement stroke and vibration of the pump station are monitored, which provides a new monitoring scheme and analysis means for a running status of the pump station.

<Hydraulic Conversion Assembly 200>

As shown in FIG. 1, the hydraulic conversion assembly 200 includes a hydraulic conversion housing 201 and a plunger 202 slidably connected in the hydraulic conversion housing 201.

The hydraulic conversion housing 201 is fitted to the outer side of the first through hole 1015 of the pump head body 101; one end of the plunger 202 is coupled to the crankcase assembly 300, the other end is inserted into the first through hole 1015.

A middle box 203 is arranged outside the hydraulic conversion assembly 200. The crankcase assembly 300 is coupled to the pump head body 101 by the middle box 203, the part of the plunger 202 coupled to the crankcase assembly 300 is located inside the middle box 203 to prevent this part from being exposed outside.

<Crankcase Assembly 300>

As shown in FIG. 1, the crankcase assembly 300 includes: a crankcase body 301 and at least one gear pair and a crank-slider mechanism located in the crankcase body 301; the input gear shaft 302 of the gear pair is coupled to the output shaft of the main drive motor; the crankshaft 304 of the crank-slider mechanism is coupled to the output gear 303 of the gear pair, and the slider 305 of the slider-crank mechanism is used to coupled to the plunger 202.

<Connection Mode of Crankcase Assembly 300 and Hydraulic Conversion Assembly 200>

Figure 4:
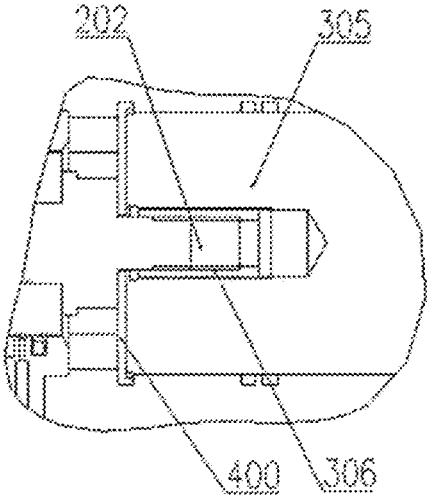
FIG. 4 is a partial schematic view illustrating a connection relationship between a plunger and a slider in a plunger pump according to the present disclosure.

As shown in FIG. 4, the end of the slider 305 of the crankcase assembly 300 is provided with a mounting hole, a reinforcing sleeve 306 is embedded in the mounting hole; the plunger 202 is threaded to the reinforcing sleeve 306. Since the plunger 202 generally is made of ceramic material, while the slider 305 is made of stainless steel material, a reinforcing sleeve 306 is arranged at the connecting end of the slider 305 and the plunger 202 to solve the problem that the plunger 202 and the slider 305 are directly coupled to the plunger 202 through threads, which leads to thread tripping and fracture, improve the coupling strength between the plunger 202 and the slider 305 is beneficial to the replacement and maintenance of the plunger 202. Specifically, the reinforcing sleeve is a steel screw sleeve with threads arranged inside and outside the reinforcing sleeve.

Since the plunger 202 is usually made of ceramic material while the slider 305 is made of stainless steel material, the direct contact between them is prone to the problem of both losses, a protective sheet 400 is arranged between the slider 305 and the end face of the plunger 202. The protective sheet 400 is made of a material softer than ceramic material and stainless steel material, such as rubber, and is squeezed between them to prevent the plunger 202 from being damaged and damaging the slider 305.

<Working Process of Plunger Pump A>

When the plunger pump A is working, after the rotary motion input by the main drive motor drives the input gear shaft 302 and the output gear 303 on the crankshaft 304 to make a first-stage deceleration motion, meanwhile, the crankshaft 304 drives the connecting rod to rotate, which is converted into the reciprocating linear motion of the slider 305 and the plunger 202, resulting in the change of volume of the chamber in the pump head assembly 100, when the slider 305 is at the farthest end, the plunger 202 causes the volume of the chamber to increase to form negative pressure, and the liquid suction valve core 1022 is opened and the liquid discharge valve core 1032 is closed, which completes the suction; when the slider is at the nearest end, the plunger 202 causes the volume of the chamber to decrease, thus compressing the sucked liquid to form high-pressure liquid, the liquid suction valve core 1022 is closed, and the liquid discharge valve core 1032 is opened to discharge the high-pressure liquid. This process completes the liquid discharge, the control of high-pressure hydraulic pressure is realized by unloading valves 110 and safety valves 111 installed on both sides of the pump head, the above two processes are the interactive and dynamic completion of five groups of plungers 202. The good sealing performance in the hydraulic conversion system prevents the liquid from leaking out, and the conical sealing between the liquid suction valve core 1022 and the liquid suction valve base 1021, and the conical sealing between the liquid discharge valve core 1032 and the liquid discharge valve base 1031 in the pump head assembly 100 jointly ensure the high volumetric efficiency of the five-plunger pump A, and make the discharged liquid flow reach more than 1200 L/min, thus meeting the actual liquid supply requirements of the hydraulic system in the super-high mining face.

<Process of the Installation and Disassemble of Plunger Pump A>

The pump head assembly of the emulsion plunger pump in the present disclosure is assembled in the following steps.

At step 1: five groups of the liquid suction valve assemblies 102 are assembled for later use, and the liquid suction valve base 1021 and the liquid suction valve core 1022 are grinded and undergo a sealing test before being assembled.

At step 2: two O-shaped retaining rings and one O-shaped ring are inserted into a sealing ring groove of the liquid discharge valve base 1031 in such a way that one O-shaped retaining ring is mounted on each side of the O-shaped ring, five groups of the liquid discharge valve assemblies 103 are assembled for later use, and lubrication grease is applied to a surface of the O-shaped ring for later use after the assembly is completed.

At step 3: a combined sealing ring is inserted into the sealing ring groove of the anti-rotation memberanti-rotation member 113; the above components need to be assembled in five groups; and lubrication grease is applied to surfaces of the combined sealing ring for later use after the assembly is completed.

At step 4: the combined sealing ring is inserted in a sealing ring groove of the liquid discharge valve core stop member 1033; the above components need to be assembled in five groups; and lubrication grease is applied to surfaces of the combined sealing ring for later use after the assembly is completed.

At step 5: the liquid suction valve assembly 102 completed in step 1 is put into the liquid suction valve assembly 102 through the upper opening of the pump head body 101 and is tapped gently with a copper bar to make it closely fitted with the pump head body 101.

At step 6: the separation sleeve 104 is placed on the liquid suction valve assembly 102 installed in step 5 through the upper opening of the pump head body 101; the anti-rotation memberanti-rotation member 113 and the blocking memberblocking member 106 are mounted at the second through hole 1016; the anti-rotation memberanti-rotation member 113 is inserted into the small hole of the separation sleeve 104; the separation sleeve 104 is positioned circumferentially and pressed with the blocking memberblocking member 106.

As step 7: the liquid discharge valve base 1031 completed in step 2 is mounted onto the upper end of the separation sleeve 104 through the assembly completed in step 6, and is tapped gently with a copper bar to make it closely fitted with the separation sleeve 104.

At step 8: the liquid discharge valve core 1032 and the second reset spring 1034 are mounted inside the assembly completed in step 7.

At step 9: the liquid discharge valve core stop member 1033 completed in the step 4 is mounted inside the assembly completed in step 8 and is tapped gently with a copper bar to make it closely fitted with the liquid discharge valve base 1031, and then is pressed by the blocking cover 105 to complete the installation of the pump head assembly 100.

When the liquid discharge valve base needs to be disassembled, the following steps should be taken.

At step 1: the liquid discharge chamber blocking cover 105 is disassembled.

At step 3: the liquid discharge valve assembly 103 is sequentially disassembled from the upper side of the pump head body 101.

At step 3: the blocking memberblocking member 106 and the anti-rotation memberanti-rotation member 113 are sequentially disassembled.

At step 4: the plunger 202 is disassembled from the side of the slider 305 along the first through hole 1015 and the second through hole 1016.

At step 5: the separation sleeve 104 and the liquid suction valve assembly 102 are sequentially disassembled form the upper side of the pump head body 101.

So far, the disassembly of each valve group inside the pump head body 101 has been completed. In the present disclosure, the disassembly and assembly of each part can be completed form one side of the pump head body 101, which is convenient for maintenance.

Figure 10:
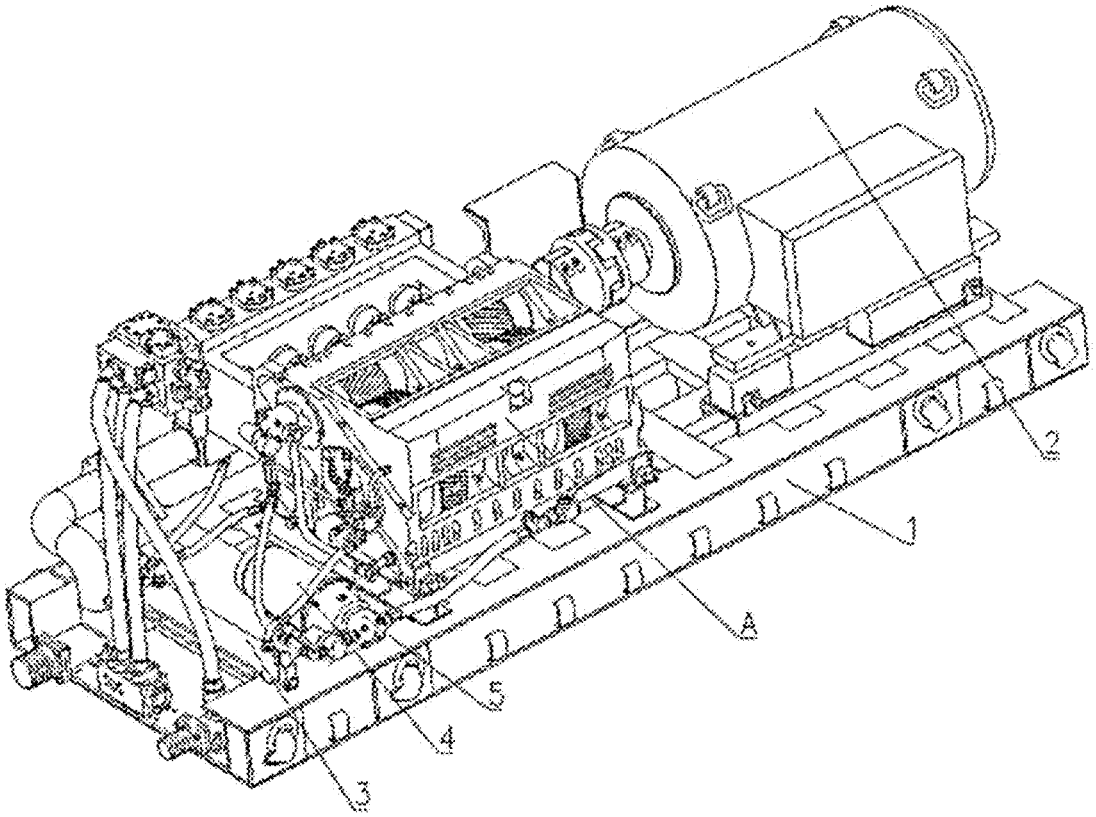
FIG. 10 is a structural diagram of a specific embodiment of a pump station according to the present disclosure.

As shown in FIG. 10, a specific embodiment of a five-plunger emulsion pump station according to the present disclosure includes a base 1, a plunger pump A and a main drive motor 2 located on the base 1. The main drive motor 2 is used to drive the plunger pump A, and the plunger pump A adopts the plunger pump A of the above specific embodiment, which is not described here.

The emulsion pump station also includes a lubrication system, which is used to lubricate the components in the crankcase assembly 300 of the plunger pump A, such as crankshaft, gear, connecting rod, bearing, slider, etc. In order to fully cool the lubrication oil during operation, the lubrication system includes a lubrication oil supply device and a cooling device.

The lubrication oil supply device includes a lubrication oil pump 5, a lubrication oil pump drive motor 4 and a lubrication oil tank (not shown in the figure); The cooling device includes: a cooling tank 3, in which an inlet of the cooling tank 3 is in connection with the lubrication oil pump 5, and an outlet of the cooling tank 3 is in connection with various lubrication points of the crankshaft, gear, connecting rod, bearing, slider and other parts in the crankcase assembly 300; and an emulsion pipeline (not shown) in the cooling tank 3, the emulsion pipeline being in connection with the pump head assembly 100 and configured to cool the lubrication oil in the cooling tank 3.

The pump station of the present disclosure adopts a cooling mode outside the plunger pump A, and a lubrication oil pump with lower power can be used to drive the motor 4, which solves problems of large oil flow resistance and low cooling efficiency of the existing cooler arranged in the liquid suction box, and meanwhile, the implementation cost is low, and a small size of the motor is more conducive to installation and maintenance in a narrow space.

Compared with the related art, the technical solutions of the present disclosure has the following technical effects.

For the plunger pump in the present disclosure, in the chamber inside the pump head body, the liquid discharge valve base mounting portion is transitioned to the separation sleeve mounting portion through the stepped surface, and the bore diameter of the liquid discharge valve base mounting portion is larger than that of the separation sleeve mounting portion, and the bore diameter of the separation sleeve mounting portion is larger than or equal to that of the liquid suction valve base mounting portion. Consequently, the liquid suction valve core assembly, the separation sleeve and the liquid discharge valve core assembly can be installed from one side of the pump head body, and compared with the related art, the assembly and disassembly is convenient with less time consumption. Meanwhile, in the present disclosure, the liquid suction chamber is directly formed in the pump head body, so there is no need for additional processing and assembly of any liquid suction box, and only a thinner blocking plate is needed to block the lower opening, which causes low manufacturing cost and simple and convenient assembly.

Furthermore, in the plunger pump according to the present disclosure, the pressure sensor, the magnetostrictive sensor and the vibration sensor are integrally mounted in the plunger pump, so that the impact force, displacement stroke and vibration of the pump station are monitored, which provides a new monitoring scheme and analysis means for a running status of the pump station.

Furthermore, in the pump station according to the present disclosure, a cooling mode outside the plunger pump is adopted, and a lubrication oil pump with lower power can be used to drive the motor, which solves problems of large oil flow resistance and low cooling efficiency of the existing cooler arranged in the liquid suction box, and meanwhile, the implementation cost is low, and a small size of the motor is more conducive to installation and maintenance in a narrow space.

Certainly, the above embodiments are only examples for clear explanation, rather than limitations on the implementations. For those skilled in the art, other changes or variations can be made on the basis of the above description. It is not necessary or impossible to exhaust all the embodiments here. However, obvious changes or variations derived therefrom are still within the protection scope of the present disclosure.

The invention claimed is:

1. A plunger pump, comprising:

a crankcase assembly configured to be coupled to a main drive motor to transmit power;

a pump head assembly configured to pump emulsion; and a hydraulic conversion assembly coupled between the crankcase assembly and the pump head assembly and configured to convert mechanical power of the crankcase assembly into a hydraulic change of the pump head assembly, wherein the pump head assembly comprises:

a pump head body having a chamber; and a liquid suction valve assembly, a liquid discharge valve assembly and a separation sleeve separating the liquid suction valve assembly from the liquid discharge valve assembly in the chamber, wherein the chamber comprises a liquid suction valve base mounting portion for mounting the liquid suction valve assembly, a separation sleeve mounting portion for mounting the separation sleeve, a liquid discharge valve base mounting portion for mounting the liquid discharge valve assembly, and a liquid suction chamber at a lower side of the liquid suction valve base mounting portion, wherein the liquid suction chamber is in connection with an emulsion supply device through a pipeline; and the liquid discharge valve base mounting portion is transitioned to the separation sleeve mounting portion through a stepped surface; a bore diameter of the liquid discharge valve base mounting portion is larger than a bore diameter of the separation sleeve mounting portion; and the bore diameter of the separation sleeve mounting portion is larger than or equal to a bore diameter of the liquid suction valve base mounting portion;

wherein the liquid discharge valve assembly comprises:

a liquid discharge valve base comprising a third matching surface;

a liquid discharge valve core slidably coupled to the liquid discharge valve base and comprising a fourth matching surface fitted with the third matching surface, wherein the third matching surface and the fourth matching surface are formed as conical surfaces;

a liquid discharge valve core stop member between the liquid discharge valve base and an upper end face of the pump head body; and a second reset spring having a first end fitted over the liquid discharge valve core and a second end abutting against the liquid discharge valve core stop member:

wherein a liquid discharge chamber blocking cover is on an upper side of the pump head body and is configured to block an upper opening of the chamber, and the liquid discharge chamber blocking cover is pressed against the liquid discharge valve core stop member and coupled to the pump head body by a screw;

wherein the liquid discharge chamber blocking cover and the liquid discharge valve core stop member comprise through holes in connection with each other in a vertical direction, and the liquid discharge valve core comprises a threaded hole; and a magnetostrictive sensor is mounted on the liquid discharge chamber blocking cover, and a telescopic rod of the magnetostrictive sensor is fixedly coupled to the liquid discharge valve core.

2. The plunger pump according to claim 1, wherein the liquid suction valve assembly comprises:

a liquid suction valve base comprising a first matching surface; and a liquid suction valve core slidably coupled to the liquid suction valve base and comprising a second matching surface fitted with the first matching surface, wherein the first matching surface and the second matching surface are formed as conical surfaces.

3. The plunger pump according to claim 2, wherein the liquid suction valve assembly further comprises:

a reset spring mounting seat at a lower side of the liquid suction valve base, the reset spring mounting seat being fitted over the liquid suction valve core; and a first reset spring between the liquid suction valve base and the reset spring mounting seat.

4. The plunger pump according to claim 3, wherein the liquid suction valve base comprises:

an outer sleeve body, an outer wall of the outer sleeve body being hermetically coupled to the liquid suction valve base mounting portion, and an end of an inner wall of the outer sleeve body comprising the first matching surface; and an inner sleeve body coupled to the outer sleeve body through a transition arm, an inner wall of the inner sleeve body being slidably coupled to the liquid suction valve core.

5. The plunger pump according to claim 4, wherein the liquid suction valve core comprises:

a valve core head comprising the second matching surface; and a valve core rod slidably coupled inside the inner sleeve body of the liquid suction valve base.

6. The plunger pump according to claim 2, wherein the liquid suction valve base comprises a pressure sensor mounting portion for mounting a pressure sensor, at a bottom of the liquid suction valve base, and the pressure sensor is configured to detect impact force during movement of the liquid suction valve core.

7. The plunger pump according to claim 1, wherein:

the pump head body comprises a first through hole and a second through hole extending coaxially along a radial direction in a region of the separation sleeve mounting portion;

the first through hole is in connection with the hydraulic conversion assembly; and an anti-rotation member for preventing rotation of the separation sleeve and a blocking member for fixing the anti-rotation member are disposed in the second through hole.

8. The plunger pump according to claim 7, wherein:

the blocking member comprises a through hole in a middle of the blocking member; and the anti-rotation member comprises a mounting hole for mounting a vibration sensor, and the vibration sensor is configured to detect vibration of the pump head body.

9. The plunger pump according to claim 7, wherein the hydraulic conversion assembly comprises:

a hydraulic conversion housing fixedly coupled to an outer side at the first through hole of the pump head body; and a plunger slidably coupled inside the hydraulic conversion housing, and having a first end coupled to the crankcase assembly and a second end inserted into the first through hole.

10. The plunger pump according to claim 9, wherein:

the crankcase assembly comprises a crankcase body, and at least one gear pair and a crank-slider mechanism in the crankcase body; and an input gear of the at least one gear pair is coupled to an output shaft of the main drive motor, a crankshaft of the crank-slider mechanism is coupled to an output gear of the at least one gear pair, and a slider of the crank-slider mechanism is coupled to the plunger, wherein an end of the slider comprises a mounting hole, and a reinforcing sleeve is embedded in the mounting hole; the plunger is threadedly coupled to the reinforcing sleeve; a protective sheet is arranged between the slider and an end face of the plunger and is squeezed between the slider and the end face of the plunger.

11. A pump station, comprising:

a base; and a plunger pump and a main drive motor being both on the base, wherein the main drive motor is configured to drive the plunger pump, wherein the plunger pump comprises:

a crankcase assembly configured to be coupled to the main drive motor to transmit power;

a pump head assembly configured to pump emulsion; and a hydraulic conversion assembly coupled between the crankcase assembly and the pump head assembly and configured to convert mechanical power of the crankcase assembly into a hydraulic change of the pump head assembly, wherein the pump head assembly comprises:

a pump head body having a chamber; and a liquid suction valve assembly, a liquid discharge valve assembly and a separation sleeve separating the liquid suction valve assembly from the liquid discharge valve assembly in the chamber, wherein the chamber comprises a liquid suction valve base mounting portion for mounting the liquid suction valve assembly, a separation sleeve mounting portion for mounting the separation sleeve, a liquid discharge valve base mounting portion for mounting the liquid discharge valve assembly, and a liquid suction chamber at a lower side of the liquid suction valve base mounting portion, wherein the liquid suction chamber is in connection with an emulsion supply device through a pipeline; and the liquid discharge valve base mounting portion is transitioned to the separation sleeve mounting portion through a stepped surface; a bore diameter of the liquid discharge valve base mounting portion is larger than a bore diameter of the separation sleeve mounting portion; and the bore diameter of the separation sleeve mounting portion is larger than or equal to a bore diameter of the liquid suction valve base mounting portion;

wherein the liquid discharge valve assembly comprises:

a liquid discharge valve base comprising a third matching surface;

a liquid discharge valve core slidably coupled to the liquid discharge valve base and comprising a fourth matching surface fitted with the third matching surface, wherein the third matching surface and the fourth matching surface are formed as conical surfaces;

a liquid discharge valve core stop member between the liquid discharge valve base and an upper end face of the pump head body; and a second reset spring having a first end fitted over the liquid discharge valve core and a second end abutting against the liquid discharge valve core stop member;

wherein a liquid discharge chamber blocking cover is on an upper side of the pump head body and is configured to block an upper opening of the chamber, and the liquid discharge chamber blocking cover is pressed against the liquid discharge valve core stop member and coupled to the pump head body by a screw;

wherein the liquid discharge chamber blocking cover and the liquid discharge valve core stop member comprise through holes in connection with each other in a vertical direction, and the liquid discharge valve core comprises a threaded hole; and a magnetostrictive sensor is mounted on the liquid discharge chamber blocking cover, and a telescopic rod of the magnetostrictive sensor is fixedly coupled to the liquid discharge valve core.

12. The pump station according to claim 11, wherein the liquid suction valve assembly comprises:

a liquid suction valve base comprising a first matching surface; and a liquid suction valve core slidably coupled to the liquid suction valve base and comprising a second matching surface fitted with the first matching surface, wherein the first matching surface and the second matching surface are formed as conical surfaces.

13. The pump station according to claim 12, wherein the liquid suction valve assembly further comprises:

a reset spring mounting seat at a lower side of the liquid suction valve base, the reset spring mounting seat being fitted over the liquid suction valve core; and a first reset spring between the liquid suction valve base and the reset spring mounting seat.

14. The pump station according to claim 13, wherein the liquid suction valve base comprises:

an outer sleeve body, an outer wall of the outer sleeve body being hermetically coupled to the liquid suction valve base mounting portion, and an end of an inner wall of the outer sleeve body comprising the first matching surface; and an inner sleeve body coupled to the outer sleeve body through a transition arm, an inner wall of the inner sleeve body being slidably coupled to the liquid suction valve core.

15. A plunger pump, comprising:

a crankcase assembly configured to be coupled to a main drive motor to transmit power;

a pump head assembly configured to pump emulsion; and a hydraulic conversion assembly coupled between the crankcase assembly and the pump head assembly and configured to convert mechanical power of the crankcase assembly into a hydraulic change of the pump head assembly, wherein the pump head assembly comprises:

a pump head body having a chamber; and a liquid suction valve assembly, a liquid discharge valve assembly and a separation sleeve separating the liquid suction valve assembly from the liquid discharge valve assembly in the chamber, wherein the chamber comprises a liquid suction valve base mounting portion for mounting the liquid suction valve assembly, a separation sleeve mounting portion for mounting the separation sleeve, a liquid discharge valve base mounting portion for mounting the liquid discharge valve assembly, and a liquid suction chamber at a lower side of the liquid suction valve base mounting portion, wherein the liquid suction chamber is in connection with an emulsion supply device through a pipeline; and the liquid discharge valve base mounting portion is transitioned to the separation sleeve mounting portion through a stepped surface; a bore diameter of the liquid discharge valve base mounting portion is larger than a bore diameter of the separation sleeve mounting portion; and the bore diameter of the separation sleeve mounting portion is larger than or equal to a bore diameter of the liquid suction valve base mounting portion;

wherein:

the pump head body comprises a first through hole and a second through hole extending coaxially along a radial direction in a region of the separation sleeve mounting portion;

the first through hole is in connection with the hydraulic conversion assembly; and an anti-rotation member for preventing rotation of the separation sleeve and a blocking member for fixing the anti-rotation member are disposed in the second through hole.

* * * * *